United States Patent [19]

Kohyama

[11] 4,341,460

[45] Jul. 27, 1982

[54] ELECTRONIC COPYING MACHINE

[75] Inventor: Mitsuaki Kohyama, Higashikurumeshi, Japan

[73] Assignee: Tokyo Shibaura Denki Kabushiki Kaisha, Kawasaki, Japan

[21] Appl. No.: 183,408

[22] Filed: Sep. 3, 1980

[30] Foreign Application Priority Data

Sep. 7, 1979 [JP] Japan ..... 54-114964
Sep. 7, 1979 [JP] Japan ..... 54-114965
Sep. 7, 1979 [JP] Japan ..... 54-123802[U]

[51] Int. Cl.[3] ..... G03G 15/00

[52] U.S. Cl. ..... 355/13; 355/3 SH; 355/14 R; 355/14 SH; 83/203; 83/365

[58] Field of Search ..... 355/14 R, 3 R, 3 SH, 355/14 SH, 7, 13; 271/9; 83/203, 365

[56] References Cited

U.S. PATENT DOCUMENTS

| | | | |
|---|---|---|---|
| 3,797,346 | 3/1974 | Kakii et al. | 355/13 X |
| 4,183,657 | 1/1980 | Ernst et al. | 355/14 R |
| 4,277,163 | 7/1981 | Ikesue et al. | 355/14 R |
| 4,294,535 | 10/1981 | Ariyama et al. | 355/14 SH |
| 4,295,731 | 10/1981 | Sasaki et al. | 355/14 R |

*Primary Examiner*—Arthur C. Prescott
*Attorney, Agent, or Firm*—Cushman, Darby & Cushman

[57] ABSTRACT

An electronic copying machine including apparatus for supplying one of at least two sizes of paper has a transparent surface for receiving a paper to be copied, a lid for covering the paper during copying, a light sensor mounted beneath the surface for directing light at a predetermined wavelength to the surface and detecting the light reflected from the surface, a first roller drive for supplying a first size of paper when the light sensor detects that the paper to be copied is that first size and a second roller drive for supplying a second size of paper when the light sensor detects the paper to be copied is the second size.

8 Claims, 6 Drawing Figures

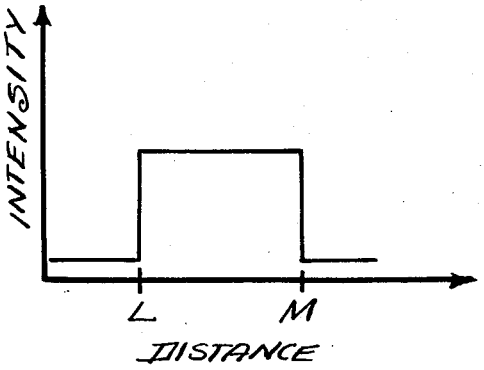
FIG. 4a
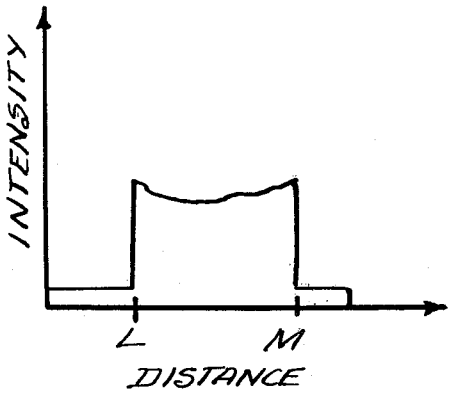
FIG. 4b
FIG. 5
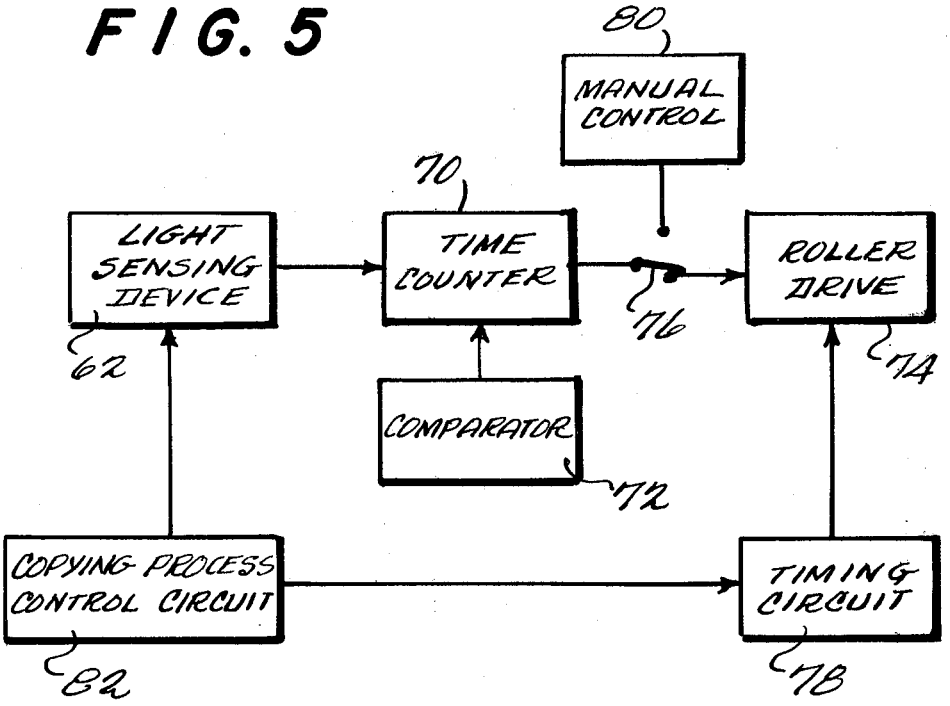

ELECTRONIC COPYING MACHINE

BACKGROUND OF THE INVENTION

This invention relates to an electronic copying machine, particularly to an electronic copying machine with an original size detector for detecting the size of the original being copied.

BACKGROUND OF THE PRIOR ART

Various types of copying machines with paper size detectors have been proposed. One of the reasons for developing the paper size detector is to realize an automatic exposing time control device depending upon the density or the brightness of an original. However, it is difficult to distinguish the brightness from the original and a lid for covering the original unless the original size is detected because the brightness is indicated as a sum of brightness from the original and the lid.

If a lid having low reflectivity, such as with a black coating, is employed, it is easy to distinguish the brightness of the original from that of the lid. However, if the original is thin or semi-transparent, a dark, dirty copy results because light directed to the original for exposing a photo-sensitive drum to make an electrostatic latent image thereon is transmitted through the original and absorbed by the lid so that light reflected to the photosensitive drum is too low to make a clear image copy.

In conventional machines, the size of an original is detected by using an optical sensing system; that is, a system including light emitting devices such as incandescent lamps and light sensors. The light emitting devices are spatially fixed beneath the glass plate which receives the paper to be copied so as to direct light to the glass plate. A plurality of light sensors are also spatially fixed and separated along the direction of paper length on a lid which covers an original placed on the glass plate so as to receive light passing through the glass plate.

Detection of paper size in this machine is achieved by detecting when the light is intercepted by the original paper. Typically, when the original paper size is B4 type, light from two light emitting devices is intercepted. On the other hand, when the original paper is A4 type, light from only one of the light emitting devices is intercepted.

However, this machine requires the light sensors to be fixed on the lid. Accordingly, the light sensors are subject to damage by shock from opening and closing the lid.

SUMMARY OF THE INVENTION

Accordingly, it is an object of the present invention to provide an improved electronic copying machine with an original size detector.

It is another object of the present invention to provide an improved electronic copying machine which realizes clear image reproduction while detecting original size.

It is another object of the present invention to provide an improved electronic copying machine with an original size detector including paper supplying device which supplies one of at least two sizes of paper.

Other objects and advantages of the present invention will be apparent from the following detailed description of the preferred embodiments taken in conjunction with the accompanying drawings.

BRIEF DESCRIPTION OF THE DRAWINGS

FIGS. 4(*a*) and 4(*b*) are graphs illustrating signals produced in a photosensitive device;

FIG. 5 is a block diagram of an electric circuit for a copying machine of the present invention.

DETAILED DESCRIPTION OF THE PREFERRED EMBODIMENT

Figure 1:
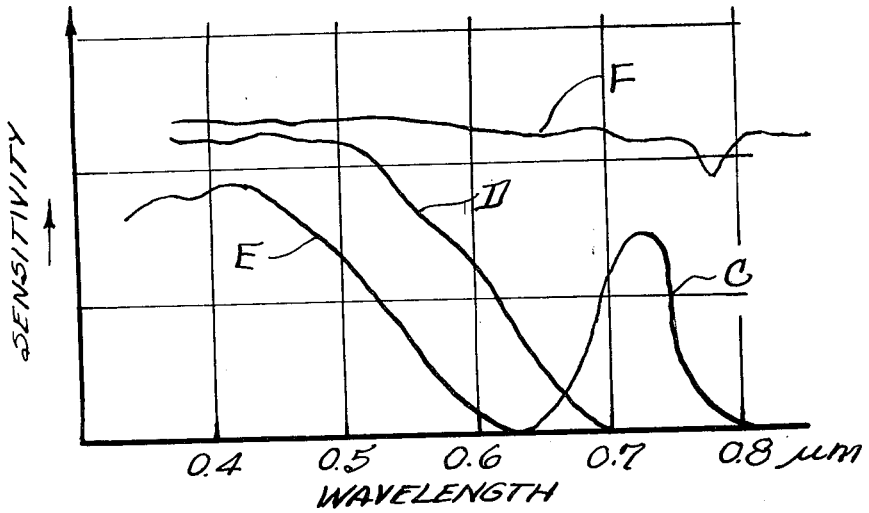
FIG. 1 is a graph showing the spectral response curves of a selenium photosensitive drum, an original paper, a lid and a photo-sensing device.
Figure 2:
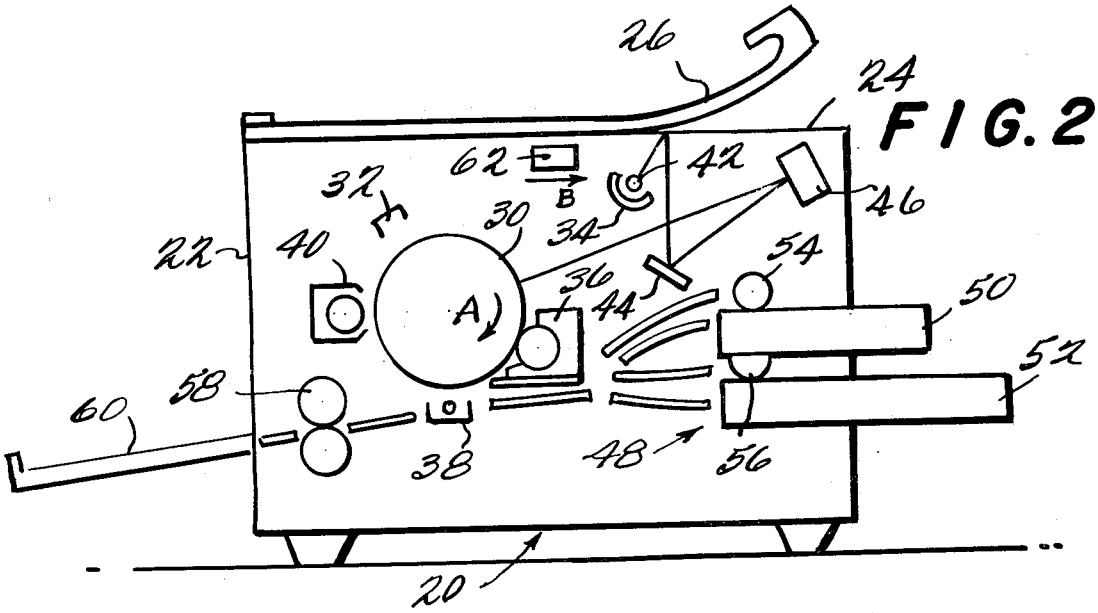
FIG. 2 is a schematic view of a copying machine of the present invention.
Figure 3:
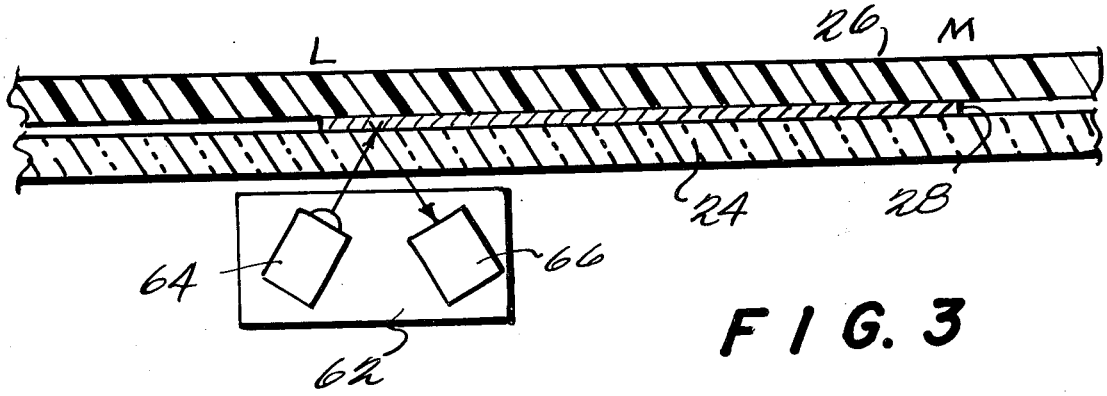
FIG. 3 is a schematic partial view of a copying machine as shown in FIG. 2.

A copying machine designated as numeral 20 has a housing 22 on which an original paper is mounted on a holder 24 which can be covered with a lid 26. The holder 24 is a transparent glass plate. Between the holder 24 and lid 26 an original paper 28 is placed. A conventional photosensitive rotary drum 30 is disposed in housing 22. Drum 30 rotates clockwise in the direction indicated by arrow A. The outer surface of drum 30 is provided with a photosensitive plate made of selenium.

Around the drum 30 a charging unit 32, an exposure unit 34, a developing unit 36, a charge-transfer unit 38 and a cleaning unit 40 are conventionally disposed.

The charging unit 32 scatters positive charge over the photosensitive plate of the rotary drum 30. The exposure unit 34 disposed at right upper side of the housing 22 includes a lamp 42, a mirror 44 and a mirror lens 46 so as to form an electrostatic latent image on the photosensitive plate of the rotary drum 30.

A paper supplying unit 48 including paper supplying cassettes 50 and 52 and paper feed rollers 54 and 56 are provided in housing 22. In paper supplying cassettes 50 and 52, different sizes of paper are stored. For example, cassette 50 stores A4 paper and cassette 52 stores B4 paper. The paper feed rollers 54 and 56 feed A4 paper and B4 paper, respectively, one sheet at a time from cassettes 50 and 52 to charge transfer unit 38.

A fixing unit 58 is also provided in housing 22. A tray 60 for receiving copied paper is attached to housing 22.

A light sensing device 62 consisting of a light emitter 64 and a light sensor 66 is provided beneath original paper holder 24. The light sensing device 62 is mounted in any suitable way beneath the original paper holder 24. The device may be fixed at a given location so that it receives light from lid 26 when one size of paper is used and from the paper being copied when the paper is of a second size. Alternatively, the device 62 can be mounted to move with respect to holder 24, at a fixed speed. Either holder 24 or device 62 may be in motion. Motion of device 62 may be initiated by operation of the copy button or otherwise, and device 62 returned to its initial position after detection is completed. During the movement of the light sensing device 62 from the left to the right as indicated by arrow B or during a given time period if device 62 is fixed, light emitter 64 directs light to holder 24. Light emitter 64 is a GaP light emitting diode. Other light emitting diodes, such as GaAs diodes or GaAsP diodes are also usable depending on the color they emit. An incandescent lamp may be used as the light emitter 64. The light sensor 66 can be a Si photo diode. However, Se photo sensors or a Cds photosensor are also usable for this purpose. An optical filter is also usable with light sensor 66.

Light sensing device 62 has a spectral sensitivity as in FIG. 1 as C. The low level constituting a first signal is produced when light is reflected from the lid and the high level constituting a second signal when light is reflected from the original paper. Light sensing device 62 is designed to produce a high level when the light sensor 66 receives light having a wavelength of 0.7 μm to 0.75 μm. The lid 26 of which spectral reflection factor is shown in FIG. 1 as D absorbs light having a wavelength of more than 0.6 μm; however, it reflects almost all light utilized for exposing the photosensitive plate of the rotary drum 30. The spectral sensitivity of the photosensitive plate of the rotary drum 30 is shown in FIG. 1 as E. The original with white paper 28, has almost flat characteristic on the spectral reflection factor over the light as shown in FIG. 1 as F.

To present such spectral reflection factor, lid 26 is made of polyvinyl chloride resin with a coating on the inside surface. The coating is preferably a coloring agent, such as cadmium red. A polyurethane resin or silicon resin can also be utilized as material for lid 26. Another coloring agent, such as mercury red, pirazon red, ultramarine, cobalt blue, copper phthalocyanine blue, chrome green, copper-phthalocyanine green or mixtures thereof can be utilized in combination of the material of the lid 26 to obtain the desired spectral reflection factor.

Light sensor 66 is arranged to receive light directed from the GaP diode 64 after reflection from original paper 28 or lid 26; however, light reflected from the original paper is much more intense because lid 26 absorbs light having a wavelength more than 0.6 μm. Light sensor 66 changes light energy to an electrical signal which intensity depends on the intensity of the reflected light energy. If a blank original is placed on the holder 24 between L and M, light sensor 66 produces electrical signals as shown in FIG. 4(*a*), when the sensor is moved. If the written paper is placed on the same place on holder 24, the photosensor 66 produces electrical signals as shown in FIG. 4(*b*) with peak values which vary according to the condition of the written paper.

As shown in FIG. 5, the electrical signal produced by light sensor 66 of light sensing device 62 is applied to a time counter 70 which measures the time the light sensor produces the second signal. Time counter 70 is connected to a comparator 72 to compare the time measured therein with a standard time signal generated in comparator 72. A roller drive 74 is connected to the time counter 70 through a switch 76. The roller drive 74 drives the paper feed rollers 54 and 56. When the time measured by time counter 70 is less than the standard time generated at the comparator 72, the roller drive 74 drives the feed roller 54 for supplying A4 size paper. On the other hand, when the time measured is more than the standard time, the roller drive 74 drives the feed roller 56 for supplying B4 size paper. The roller drive 74 is also connected to a timing circuit 78 for supplying paper from the cassettes 50 and 52 to the transfer unit 38 in good time for transferring the image thereon. Accordingly, unless the roller drive 74 receives a signal from timing circuit 78, neither of the paper feed rollers 54 and 56 is operated. A manual control 80 is used for supplying paper regardless of detection of original paper size. A conventional copying process control circuit 82 is connected to the light sensing device 62 and timing circuit 78 for performing a series of copying functions such as driving the light sensing device 62 reciprocally, charging the photo-sensitive plate of the drum 30, exposing by lamp 40 and timing for supplying paper to the transfer unit 38.

Figure 6:
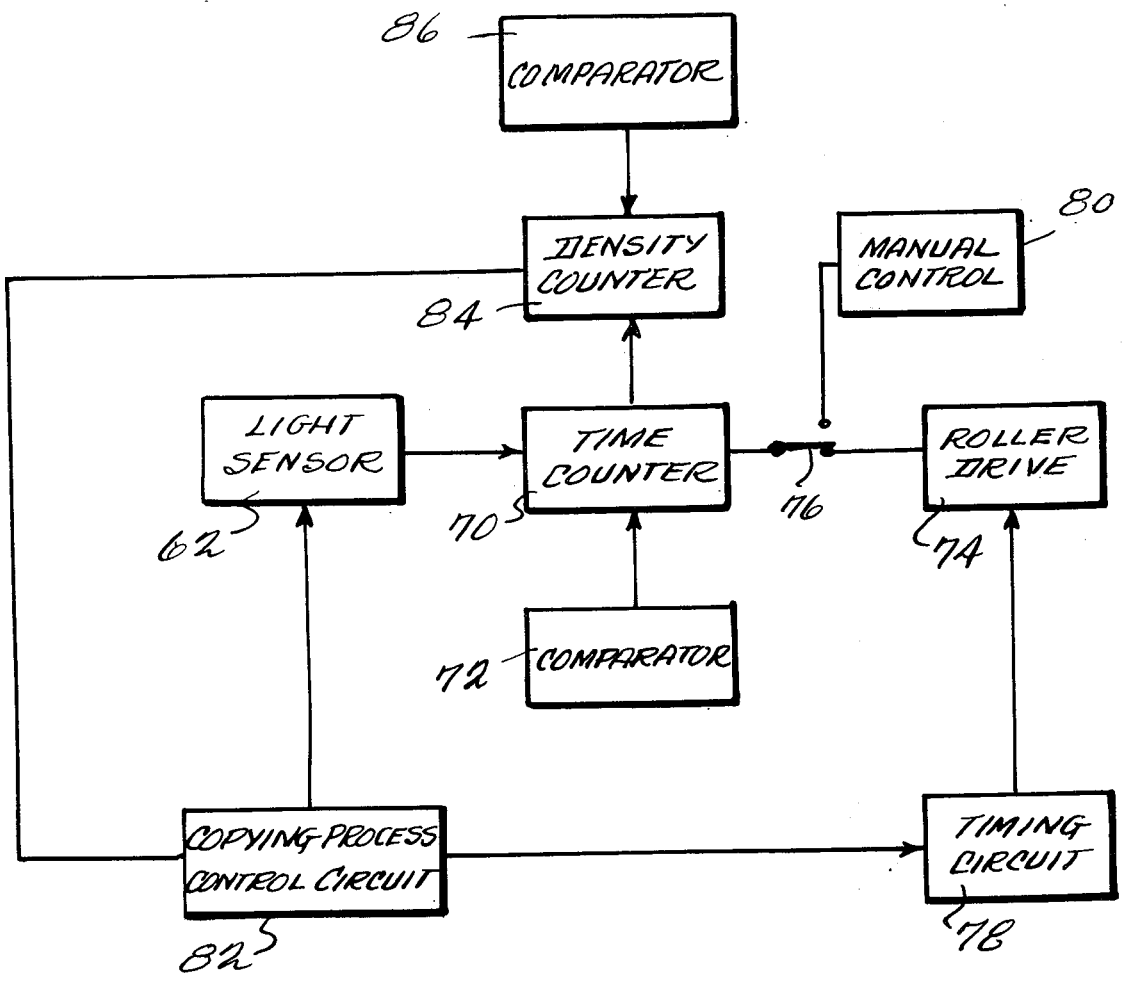
FIG. 6 is a modification of the block diagram shown in FIG. 5.

FIG. 6 shows a modification of the block diagram of the electrical circuit shown in FIG. 5. As described above, reflected light from written original paper produces the waveform as shown in FIG. 4(*b*). The density counter 84 integrates density from L to M. The comparator 86 compares density measured at the density counter 84 with standard density generated thereat. The compared density signal is sent to the copying process control circuit 82 for adjusting exposure time for copying. Accordingly, density control is automatically obtained by using the invention.

As described in detail above, original size is determined by detecting light which is directed from beneath the original holder and reflected at only the original and proper size of paper is supplied to be copied. Also, density of the original is obtained by detecting the original size, which can realize an automatic exposing time control device.

Many changes and modifications in the above-described embodiments can be carried out without departing from the scope of the present invention. That scope is intended to be limited only by the scope of the appended claims.

What is claimed is:

1. A method of detecting the size of an original to be copied in a copying apparatus by utilizing an electrostatic latent image formed on the surface of photo insulating material, said original being placed between a transparent surface and a cover which has less reflectivity to light at one given wavelength than at a second given wavelength and different reflectivity from said original to said one given wavelength, said photo insulating material being exposed by light including at least said second given wavelength comprising:

directing said light at said one given wavelength onto said cover and said original;

detecting the intensity of light received at substantially said one given wavelength;

producing a first signal indicating when said received light is reflected from said cover and a second signal indicating when said received light is reflected from said original and comparing said first signal and said second signal to produce a signal indicating the size of said original.

2. A method as in claim 1, further including the step of supplying to said copying apparatus paper of a first length when said second signal is produced for longer than a given time and paper of a second length when said second signal is produced for less than said given time.

3. A method as in claim 1 or 2 further including the step of integrating the second signal whereby the density of the original is obtained.

4. A method of detecting the size of an original to be copied by utilizing an electrostatic latent image formed on the surface of photo-insulating material, said original being placed between a transparent surface and a lid, said lid having less reflectivity to a first frequency range than to a second frequency range, said photo insulating material being exposed by light including at least said second frequency range, said method comprising the steps of:

directing light to said lid and said original;

detecting the intensity of light reflected during said directing step; and producing a signal related to the amount of light in said first frequency range detected in said detecting step, said signal having a first value when light is reflected from said lid, and a second value when light is reflected from said original and comparing said signal with a reference to produce a signal indicating the size of said original.

5. A method as in claim 4, further including the step of supplying to said copying apparatus paper of a first length when said second value is produced for longer than a given time and paper of a second length when said second value is produced for less than said given time.

6. A method as in claim 4 or 5 further including the step of integrating the second value whereby the density of the original is obtained.

7. Apparatus for supplying one of at least two sizes of paper to a copying machine having a transparent surface for receiving an original to be copied, a lid for covering said paper during copying which has less reflectivity to light at a first wavelength than a second wavelength and photo insulating material on which an electrostatic latent image is formed and which is exposed by light including at least said second wavelength comprising:

sensor means mounted at at least one given location beneath said surface for directing light substantially at said first wavelength to said surface and detecting the light reflected from said surface, said light producing a first signal when reflected from said lid and a second signal which is substantially less than said first level when reflected from said original;

first means for supplying a first size of paper to said machine;

second means for supplying a second size of paper to said machine;

means for receiving said first and second signals and determining the size of original on said surface;

means connected to said receiving and determining means for causing said first mans to supply when a first size of paper is on said surface and for causing said second means to supply when a second size of paper is on said surface.

8. A copying apparatus comprising:

a housing;

a transparent surface on said housing for receiving an original to be copied;

a lid for covering said original during copying and reflecting at a given wavelength substantially less light than said paper said lid having less reflectivity to a first frequency range than to a second frequency range;

copying means in said housing for receiving an image formed by light reflected from said original, forming an electrostatic image thereon, and copying said image onto a sheet of copy paper, said copying means being exposed by light at least in said second frequency range;

sensor means in said housing for detecting the light reflected from said surface at at least one given location, said light being reflected from said original or said lid depending upon the size of said original and producing a signal indicating whether said light is reflected from said original or said lid; and means in said housing for supplying copy paper to said copying means in accordance with a signal.

* * * * *